US005746136A

United States Patent [19]

Hawthorne et al.

[11] Patent Number: 5,746,136

[45] Date of Patent: May 5, 1998

[54] DYNAMICALLY STABLE, LIGHTWEIGHT RAILCAR SUPPORT SYSTEM

[75] Inventors: Vaughn Terrey Hawthorne, Lisle; Charles P. Spencer, Staunton, both of Ill.; Terry L. Pitchford, St. Louis, Mo.

[73] Assignee: Amsted Industries Incorporated, Chicago, Ill.

[21] Appl. No.: 713,987

[22] Filed: Sep. 13, 1996

[51] Int. Cl.[6] ..... B61F 5/00

[52] U.S. Cl. ..... 105/199.3

[58] Field of Search ..... 105/199.1, 199.3, 105/199.4

[56] References Cited

U.S. PATENT DOCUMENTS

| | | | |
|---|---|---|---|
| 3,664,269 | 5/1972 | Fillion | 105/199 C |
| 3,762,339 | 10/1973 | Dwyer | 105/199 CB |
| 3,845,725 | 11/1974 | Gierlach | 105/197 DB |
| 4,030,424 | 6/1977 | Garner et al. | 105/182 R |
| 4,108,080 | 8/1978 | Garner et al. | 105/199 CB |
| 4,173,933 | 11/1979 | Kayserling | 105/182 R |
| 4,196,671 | 4/1980 | Herring, Jr. et al. | 105/199 R |
| 4,211,311 | 7/1980 | McMullen | 188/209 |
| 4,434,720 | 3/1984 | Mulcahy et al. | 105/199 CB |
| 4,706,571 | 11/1987 | List | 105/168 |
| 4,773,335 | 9/1988 | Smith et al. | 105/4.3 |
| 5,000,097 | 3/1991 | List | 105/167 |
| 5,005,489 | 4/1991 | Terlecky | 105/158.2 |
| 5,024,166 | 6/1991 | Ahlborn et al. | 105/453 |
| 5,039,071 | 8/1991 | Irle et al. | 267/52 |
| 5,083,513 | 1/1992 | Kobayashi | 105/168 |
| 5,138,954 | 8/1992 | Mulcahy | 105/199.3 |
| 5,386,783 | 2/1995 | Rhen et al. | 105/199.3 |
| 5,438,934 | 8/1995 | Goding | 105/199.3 |

OTHER PUBLICATIONS

Pp. 492, 506, 507, 508, 509 and 497 from the Car & Locomotive Cyclopedia (No Date).

Article entitled "A Lightweight, Improved Performance Truck for the Trinity HPIT Car", from the American Society for Engineers, 1993.

*Primary Examiner*—Mark T. Le

*Attorney, Agent, or Firm*—Edward J. Brosius; F. S. Gregorczyk; Stephen J. Manich

[57] ABSTRACT

A freight railcar undercarriage constant-contact sidebearing arrangement provides a load force transfer mechanism with a more direct or less redundant force transfer path between the railcar body with its lading and the sideframe and wheels of a truck assembly, which system obviates the present use of a bolster center plate structure for load transfer, carries all the load forces through the side bearing assemblies, fulfills the dynamic operating requirements of the American Association of Railroads standards, reduces the weight of the railcar while maintaining the load-carrying capacity, and is particularly adaptable to three-piece truck assemblies in broad use on freight railcars.

21 Claims, 5 Drawing Sheets

DYNAMICALLY STABLE, LIGHTWEIGHT RAILCAR SUPPORT SYSTEM

FIELD OF THE INVENTION

The present invention relates to railcar support systems, and more particularly to a lightweight, three-piece railcar truck, which simultaneously optimizes dynamic truck stability for both static and dynamic railcar body loading, reduces turning restraint between the car body and the railcar truck, and significantly reduces the weight of both the three-piece truck and the railcar body .

BACKGROUND OF THE INVENTION

Conventional railcar support systems are well known in the industry and they typically consist of a railcar body resting upon three-piece trucks. Three-piece trucks are typically comprised of two longitudinally extending sideframes interconnected by a laterally extending truck bolster. The sideframes are generally positioned parallel to both the wheels and the rails. The railcar body bolster is a complementary member of the support system, which is a structural member on the underside of the railcar body. There is generally one car body bolster dedicated to each three-piece truck. The railcar body bolster spans the railcar width, and it includes a medial, male center plate dish for transferring payload forces from the railcar, directly into the truck bolster. The truck bolster has a female center plate bowl for mating with the corresponding railcar body bolster center plate dish. The lading or payload forces from the car body bolster are distributed through the truck bolster into each of the sideframes for transfer into the railcar truck wheels and railway tracks.

In many conventional freight cars such as box cars, open and covered top hopper cars, and gondola cars, the railcar sides are structurally designed to carry the payload and the weight of the car. The path of the payload forces from the railcar into the three-piece truck can generally be traced from the railcar volume and structural members through the railcar bolster to the car body male centerplate then to the truck bolster through its female centerplate , and finally through the sideframes, spring pack suspension members and wheels to the railway tracks. In gondola and hopper railcars, the payload supporting forces are distributed to the sides of the railcars by a body bolster. However, the construction of the structure is dependent upon the type of railcar, that is box cars and "mill" gondola cars may both have a lower section without an upper support member, whereas hopper cars and high side gondola railcars may have both an upper support member, such as an I-beam, and a lower member. Railcar side sills are located at the lower side of the railcar side walls and generally extend the longitudinal length of the railcar body. The vertical load in the railcar is communicated through the railcar bolster center plate dish to the three-piece truck bolster center plate bowl. The truck bolster, which has its ends in the parallel side frames, is generally nested on spring packs and communicates the load forces to the spring pack and thus to the lower segment of the side frame and the associated pedestal jaws thereon. These load forces are transferred to the bearings, axles, wheels and wheel contact points with the rail tracks.

With the above-noted conventional loading scheme, the railcar body structure, the railcar body bolster and the truck bolster are major components in the transfer of forces from the lading and railcar body. The sideframes have a truss-like structure with a top member, a bottom member and, interconnecting vertical columns or pillars. During static loading the top member undergoes compression and the bottom member experiences tensile or stretching forces, which effectively causes the sideframe to behave like a 'truss'. As the railcar body bolster and the truck bolster are mated at the medial center plate bowl and dish areas, they communicate equal and opposite forces against each other. Thus, the bolsters may be characterized as a simply supported beam having an intermediate load at their respective center plate areas.

In this latter configuration, the structure will have a maximum beam bending moment and a reversing shear load in the region of the medial load. It should be understood that the car body bolster shear and moment diagrams would be similar to the truck bolster shear and moment diagrams in magnitude, but opposite in sign and direction. With a conventional loading scheme where all of the load forces are transferred at the railcar and truck center plate areas, each of the car and truck bolsters have to withstand relatively large shear forces and bending moments. Therefore, each railcar and truck bolster are structurally heavy components and become a major contributor to the overall mass or weight of the vehicle system. Thus it can be appreciated that the concentration of forces and force transfer at the center plate is not the ideal location for load transfer if the overall weight of the railcar vehicle is to be reduced.

The center plate, however, is an almost ideal dynamic performance location, as the center plate area acts as a balanced pivot point when the railcar body rocks along its longitudinal axis. That is, when a railcar body rolls relative to each of the truck sideframes along its longitudinal length, the center plates effectively act as a pivot point for such railcar body roll.

The forces causing the railcar body to roll from side-to-side are considered the "dynamic" forces acting upon the railcar suspension system. These dynamic forces are imputed forces caused by actions such as travel through curves or track irregularities, which might be misaligned joints or uneven rails. These dynamic forces have a significant impact on the suspension system. As a guideline and recommended standard, the American Association of Railroads (AAR) has specified the dynamic performance requirements of the suspension system at Chapter XI, section M-1001. More specifically, the standards dictate that during railcar body roll, the minimum load on any given wheel, which is opposite the direction of roll, must be at least ten (10) percent of the static wheel load that the same wheel would experience when on a tangent track. The stated requirement or standard is a protection against one side of the railcar truck from becoming so lightly loaded that wheel lift could occur, which potentially could cause an entire side of the railcar truck to lose contact with the rails and possibly derail.

In a loaded railcar, the conventional center plate location is also an ideal location for reduction of turning restraint between a three-piece truck and a railcar body on a curve. Conventionally loaded railcars typically provide sidebearings between the railcar and truck bolsters to dynamically stabilize the railcar body during the longitudinal rolling condition. A sidebearing is generally positioned on each side of the center plate area along the bolster length to absorb part or all of the load during railcar rolling.

As noted above, the static load of the freight railcar is usually transferred to a railcar body bolster along its length, which is transverse to the railcar longitudinal axis, and then communicated to the railcar body bolster center plate, the three-piece truck bolster center plate and thereafter, the sideframes and wheels. This force loading and force transfer path has been scrutinized and reviewed by design engineers, and it is considered to be an excessive force-transfer path, which requires redundant load-bearing members and added railcar mass. In the railcar industry, there has been and continues to be a concerted effort to reduce the mass of conventional freight railcars, but no currently known freight vehicles with typically utilized three-piece trucks avoid the redundant load transfer path and components. A more direct load path would potentially reduce the number of component load transfer members thereby reducing railcar mass, lowering cost and increasing fuel savings for the same load carrying capacity car, and increasing the capacity for the same loaded weight railcar.

However, eliminating load paths and reducing the mass of major structural components, such as the railcar body bolster and the truck bolster, must be accompanied by maintenance of safety and performance criteria outlined by the AAR. Changes in the static load bearing characteristics and components of a railcar result in changes in the dynamic operating characteristics of the railcar. These changes must be able to accommodate both the static and dynamic loading requirements of the AAR specifications, as well as reducing the mass of the railcar.

U.S. Pat. No. 4,030,424 to Garner et al. provides a less redundant load path from the railcar body to the truck. The weight of the railcar and lading is supported by car body bearing assemblies attached to the top surface of the truck bolster, which is to contact a side bearing support assembly downwardly extending from the railcar body bolster. This assembly appears to reduce the mass of the railcar body bolster, however, it requires the utilization of manufactured sideframes with added transom elements to provide rigidity and stability to the H-shaped truck configuration. Further, the manufactured sideframes and truck bolster appear to incorporate a plurality of welded connections, which may have a tendency to crack during truck warping from dynamic loading.

Truck warping is an out-of square condition where the sideframes experience longitudinal movement with respect to each other. The Garner et al. transom arrangement restricted the railcar truck from adapting to other warping conditions, such as those induced by track irregularities. This Garner et al. truck design does not utilize conventional friction shoes in the truck bolster for damping truck oscillations, but the center plate arrangement does include a pin, and it is noted that little or no load is taken at the center plate.

In U.S. Pat. No. 5,138,954, a railcar and truck suspension system eliminated a redundant load path. The truck suspension only supports the railcar body at the outer sides This loading or force transfer scheme significantly reduced the weight of the railcar body bolster, as no vertical loads were transferred between the car body and the truck along the region extending between the truck sideframes. However, this design required a laterally longer truck bolster, which extended outwardly beyond the sideframes to transfer the load through the body side rails. This car body bolster was lighter between the sideframes than a conventionally loaded bolster, and the bending moments and shear forces, for this assembly were substantially reduced from the same parameters experienced by a conventional truck. However, with the payload forces directed entirely outside the sideframes, this truck did not provide the desired dynamic performance characteristics for the above-noted AAR ten (10) percent static wheel-load requirement, nor did it provide a reduced turning moment necessary to prevent wheel flanging on curves. Wheel flanging is a condition of dragging or hard contact between the railcar wheel flange and the rail track.

A recent truck system illustrating a means for eliminating the redundant load force transfer path is the subject of pending U.S. patent application Ser. No. 08/138,497, now U.S. Pat. No. 5,438,934 commonly assigned to the assignee of the present application. In the disclosed truck system, the weight of the railcar body is carried directly over the journal bearing centerlines, which was considered to be the most desirable for both static and dynamic operating considerations. Relocating the load over the journal bearing centerlines reduced the railcar body bolster structure and significantly reduced the weight of the truck bolster, which maximized the weight reduction in this truck. This truck has a lightweight and open C-shaped beam in the portion between the sideframes with conventional solid ends. Moving the load transfer points inward of the railcar body side rails to the journal centerlines improved the dynamic performance of the truck system in comparison to the above-cited system of U.S. Pat. No. 5,138,954. However, this system design did not provide a low enough turning resistance to prevent wheel flanging on curves. Further in this design, the housing assembly for directly transferring the payload from the car body to the truck bolster ends is both cumbersome and uneconomical to manufacture and assemble.

SUMMARY OF THE INVENTION

The present invention provides a railcar bolster and three-piece truck bolster couple with side bearings and coupling center pin to obviate center plate requirements, to reduce the number of load transfer components, to overcome wheel flanging and to reduce turning restraint thus allowing the truck to turn more easily on curves relative to the car body, to optimally position the side bearings to communicate the dynamic and static loads to the railcar truck sideframes while maintaining the performance criteria to AAR specifications. The vertical railcar body bolster and truck bolster load path distances are significantly reduced, thus permitting utilization of a lightweight railcar body and truck bolster to maximize weight reduction in the vehicle; a low coefficient of friction interface at the sidebearing between the car body bolster and the three-piece truck bolster provides a low-restraint to turning between the car body and the truck; and, side bearing supports inboard of the sideframes increase the dynamic stability of the railcar body.

BRIEF DESCRIPTION OF THE DRAWINGS

In the several figures of the Drawings like reference numerals identify like components, and in those Drawings.

DETAILED DESCRIPTION OF THE PREFERRED EMBODIMENT

Figure 9:
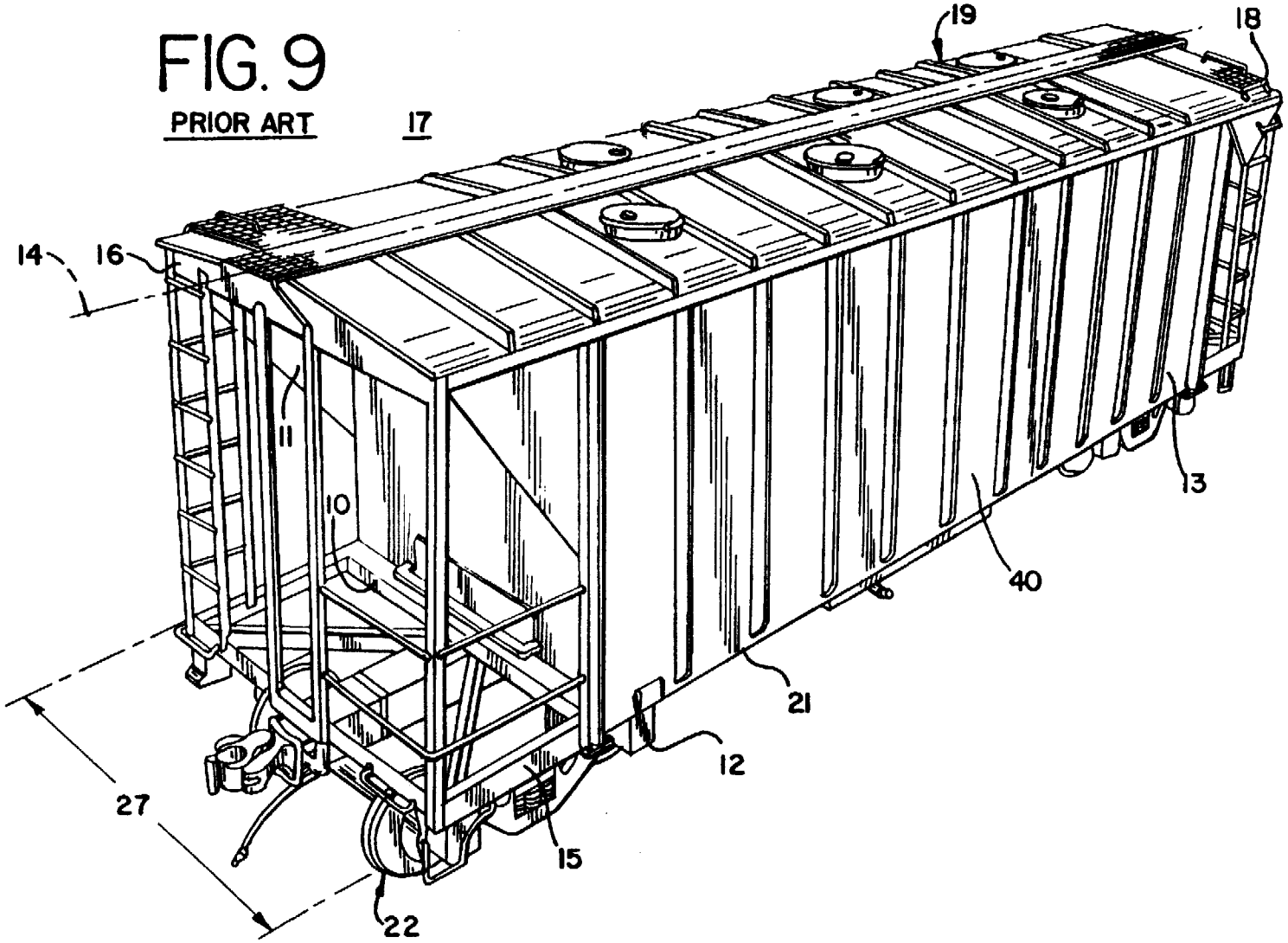
FIG. 9 PRIOR ART

A railcar body bolster and truck bolster assembly with a location sensitive arrangement of load-carrying side bearings obviates the requirement for center plate reinforced bolsters in freight railcars, which center plates support the vertical load from the lading and railcar weight transferred through the railcar sidewalls. A hopper railcar 17 in FIG. 9 provides an exemplary illustration of a freight railcar with railcar body 19 having first sidewall 11, second sidewall 13, first body end 16, second body end 18, longitudinal axis 14 and side sills 15 extending between first end 16 and second end 18 at lower edge 21 of each of sidewalls 11 and 13. Railcar truck assembly 22 at first end 16 is positioned below railcar body bolster assembly 12. A second truck assembly 22 is noted at second end 18 and the description of truck 22 will also apply to such second truck assembly.

Figure 4:
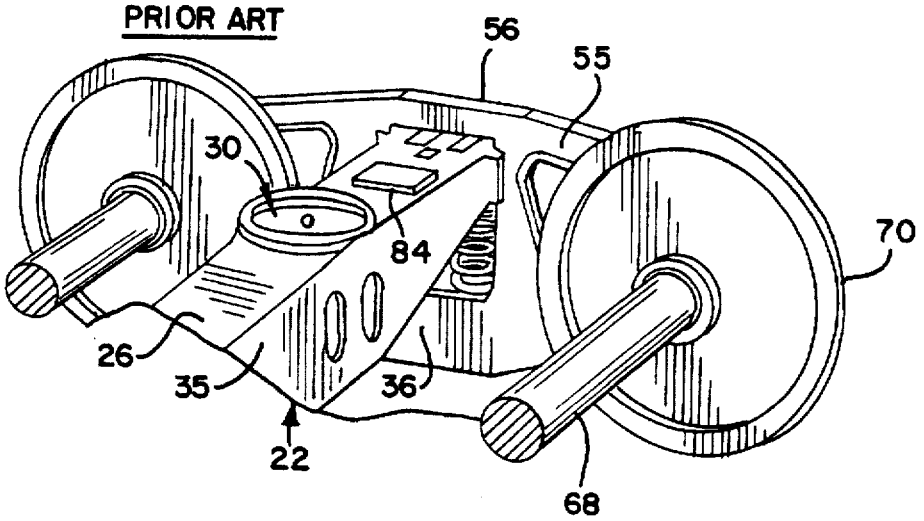
FIG. 4 PRIOR ART
FIG. 4 is an oblique view of a partial section a conventional truck bolster and side frame.

Truck assembly 22 with truck bolster 35, center plate bowl 30 and sidebearing pad 84 is illustrated in FIG. 4 and has truck bolster end 32 mated within sideframe window 36. An elevational end view in FIG. 5 of a prior art freight railcar 17 with railcar floor bottom 88 and perimeter 89 has truck bolster 35 and body bolster assembly 12 with a center plate assembly 24 at a static state. Railcar 17 in FIG. 6 has constant-contact truck bolster and body bolster side bearing assemblies 250. Railcar body bolster assembly 12 includes railcar structure 10 and box section 20 in FIG. 7 with center plate assembly 24, which is noted in an enlarged sectional view in FIG. 8. Each of these truck bolster, body bolster and center-plate assemblies is referenced below in greater detail.

Figure 1:
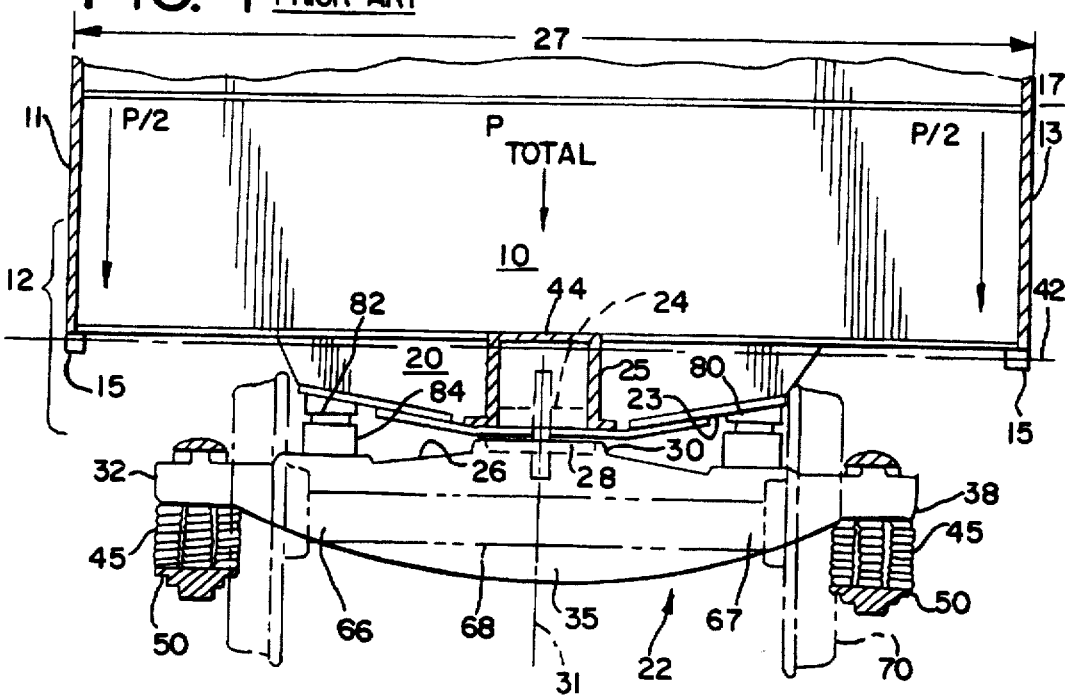
FIG. 1 PRIOR ART
FIG. 1 is a cross-sectional end view of a conventional railcar hopper or high sided gondola car body with a truck assembly showing the points of loading.

The letter designation "$P_{total}$" in FIG. 1 represents the load at one of the railcar trucks 22 of a typical railcar 17, or one-half of the total payload of railcar 17 as well as one-half of the weight of railcar body 19, as there are usually two truck assemblies 22 to support the railcar. The noted load arrows, "P/2" , at the opposite sides of the railcar illustrate one-half of the load at the one truck assembly. In some conventional freight railcars 17 with longitudinal axis 14 (e.g., box cars, open and covered-top hopper cars, and gondola cars), railcar sides 11 and 13 are structurally designed to carry some of the lading load or force and the weight of railcar 17. Load paths 90 in FIG. 5 for these forces from the weight of the railcar and lading into the railcar truck assembly are generally traced through the illustrations of the exemplary structural support suspension system shown in FIGS. 1 and 1A. Load paths 90 are noted as a dashed line from side walls 11 and 13 in FIG. 5 for a conventional railcar. Load paths 92 in FIG. 6 are the sole load path for the presently disclosed railcar and truck assembly arrangement.

Figure 1A:
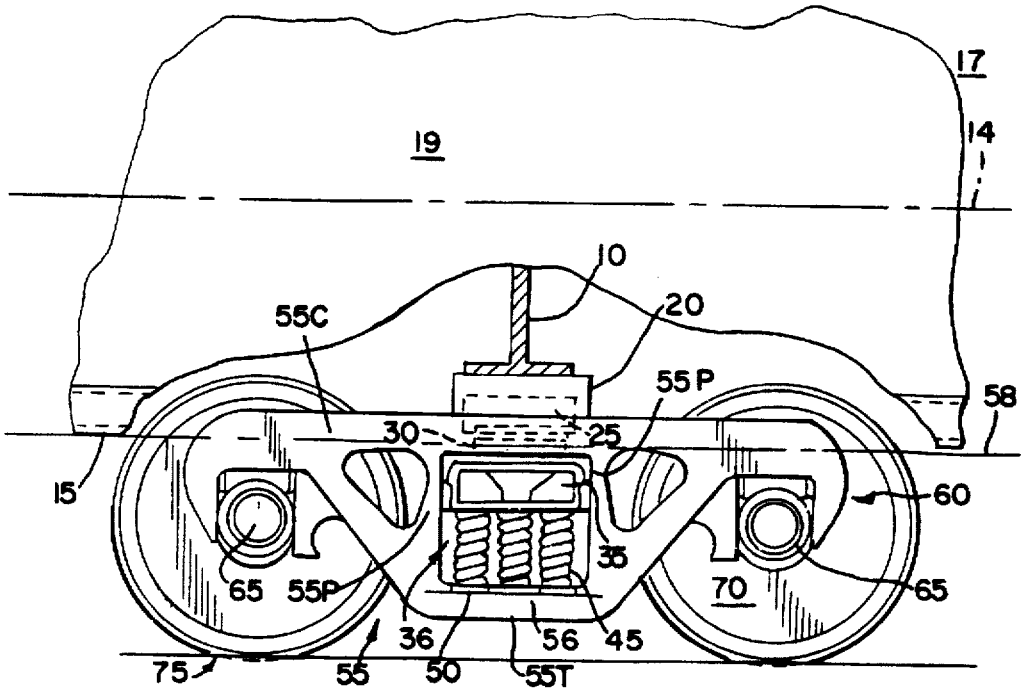
FIG. 1A PRIOR ART
FIG. 1*a* is a side view of the truck shown in FIG. 1.
Figure 5:
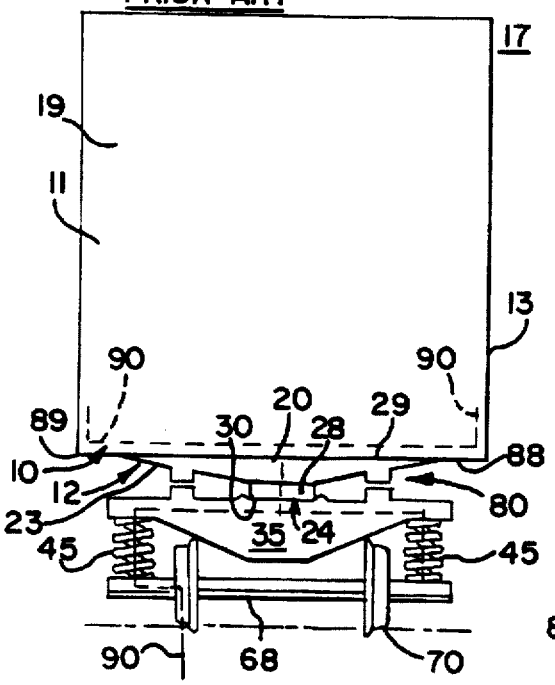
FIG. 5 PRIOR ART
FIG. 5 is an elevation view of a prior art railcar body and truck assembly at a static and reference condition.
Figure 6:
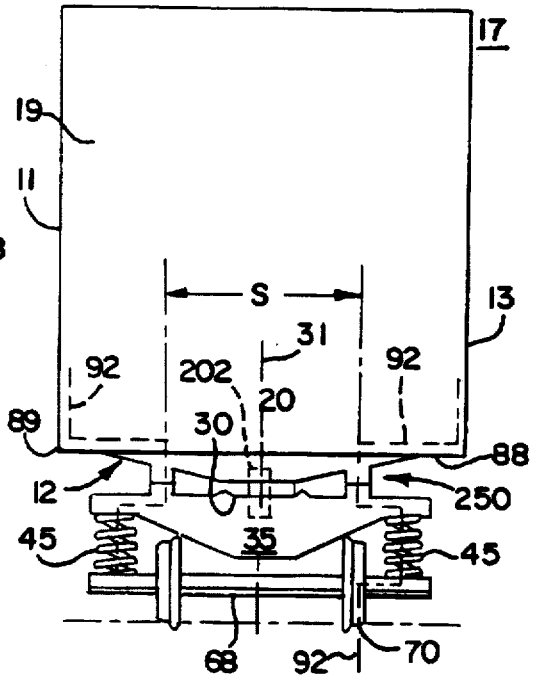
FIG. 6 is an elevation end view of the railcar in FIG. 5 with constant contact, truck assembly side bearings.

In FIGS. 5 and 9 as an example, load $P_{total}$ in lading volume 40 of hopper cars 17 is first distributed from railcar body 19 into underlying railcar structure 10, which structure or member 10 laterally extends across railcar width 27 between first sidewall 11 and second sidewall 13. This exemplary structural member 10 is designed to distribute the load, that is car weight and lading, to and through sidewalls 11 and 13, to railcar side sills 15, for transfer to body bolster assembly 12 and truck bolster 35 through structural members 10 and 20. Upper structural member 10 is typically constructed from a heavy gauge steel component such as an I-beam, H-beam, or other channel shape to provide the greatest resistance to static and dynamic deflection and bending moments from load $P_{Total}$. Railcar structure 17 in FIGS. 1 and 1A shows single I-beam 10 and box section 20, which structure is not a limitation, as it is understood that the arrangement of the underlying structure is dependent upon the railcar type. As an example of a variation in structures, a box car or a "mill" gondola car both have box section or body bolster 20 extending between sidewalls 11 and 13 without an upper member 10, whereas hopper cars and high side gondola cars, have both upper member 10 and box member 20. However, these railcar structure variations are not limitations to the present invention.

Figure 2:
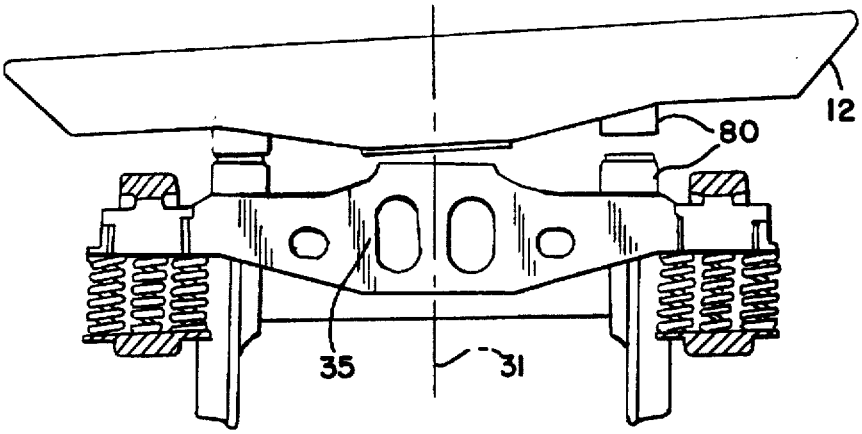
FIG. 2 PRIOR ART
FIG. 2 is an end view of a conventionally loaded truck during a lateral car body roll.
Figure 7:
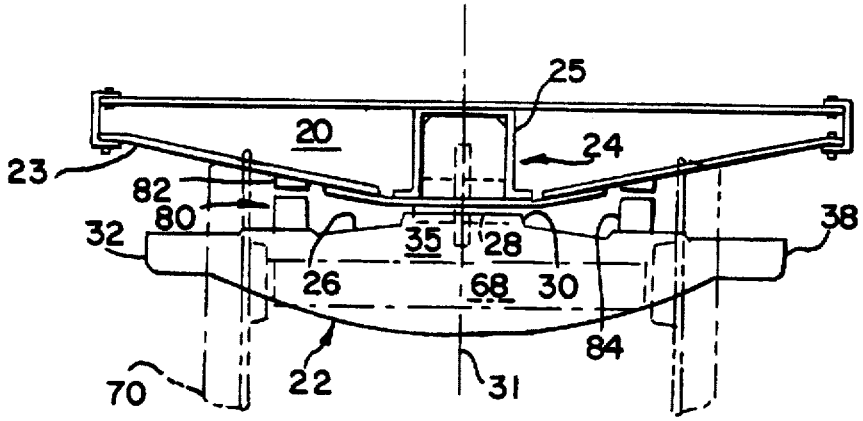
FIG. 7 PRIOR ART
FIG. 7 is an elevation end view of a railcar body bolster and truck assembly illustrating a center plate support assembly in the railcar body center sill.
Figure 8:
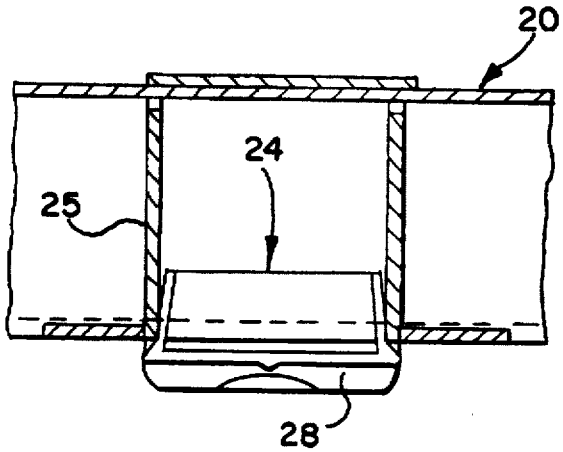
FIG. 8 PRIOR ART
FIG. 8 is an enlarged view of the center plate support and pivot bowl of FIG. 7; and, FIG. 9 is an oblique view of an exemplary freight railcar.

Side sills 15 in the illustration of FIGS. 1, 1A and 9 are located at each of the distal ends of railcar width 27, and extend the longitudinal length of railcar body 19. Load P/2 noted in FIG. 1 is transferable through load path 90 shown in FIG. 5 from sidewalls 11 and 13 to railcar body bolster assembly 12 with upper surface 29 and lower surface 23, structural members 10 and 20, through center-plate assembly 24 with body bolster center plate dish 28 within center sill webs 25 at about body-bolster midpoint 44. Female center plate bowl 30 on truck bolster 35 in FIG. 7 is mated with dish 28 for transfer of load $P_{Total}$ to bowl 30. Load $P_{Total}$ travels outwardly from bowl 30 at truck bolster center 31, toward bolster first end 32 and second end 38, to support springs 45 for absorption and transfer of the forces into spring seats 50 of each truck sideframe 55. Extant side bearing assemblies 80 in FIG. 7 include upper bearing pad 82 mounted on body bolster lower surface 23 and lower bearing pad 84 on truck bolster upper surface 26. Lower or truck bolster side bearing pads 84, as shown in FIG. 4, may be rectangularly shaped, for example. However, in railcars 17 with center plate assemblies 24, side bearing assemblies 80 are not the primary load bearing member nor are they constant-contact sidebearings, rather they function to carry angular displacement or body roll of railcar body 19, which body roll from a railcar vertical position is illustrated in FIG. 2.

Although only one sideframe 55 and the force transfer therethrough will be described, the description is applicable to both sideframes of truck assembly 22. In FIG. 1A, each spring seat 50 is integrally cast as part of bottom sideframe member 55T, allowing load P/2 to uniformly transfer throughout sideframe 55, including transfer to each pedestal jaw 60. Each pedestal jaw 60 captures a roller bearing 65 on an axle end 66, 67 of each axle 68. The forces received by roller bearings 65 are transferred into wheels 70, and subsequently into each rail at contact points 75.

In typical freight applications, sideframes 55 are a conventional truss type, and whether they are fabricated or cast, a conventional truss sideframe includes top member 55C, bottom member 55T, and interconnecting vertical columns or pillars 55P. Columns 55P form sideframe opening or window 36 at about sideframe longitudinal midpoint 56 to laterally accept an end 32 or 38 of truck bolster 35. At vertical loading of truck bolster 35, or when load forces P/2 are acting downwardly on spring seat 50, axles 68 counteract the forces at axle ends 66, 67, thereby statically balancing the system. During static loading, top member 55C undergoes compression, while lower member 55T undergoes tension or stretching, causing the sideframe structure to effectively behave like a truss.

In the above-described conventional support scheme, railcar body 19, car body bolster assembly 12 with longitudinal axis 42, members 10 and 20, center plate assembly 24 (cf., FIGS. 7 and 8), and truck bolster 35 provide major load path 90 for transferring the lading and car body weight forces from car body 19, into truck assembly 22. As railcar body bolster members 10, 20 and truck bolster 35 are mated at center plate bowl 30 and dish 28, they experience equal and opposite forces against each other. Railcar body 19 and truck bolster 35 can be generally characterized as a simply supported beam having an intermediate force load at its respective dish 28 and center plate bowl 30 region. A static beam bending moment and shear load exist in the region of the intermediate force load. From truck bolster shear and moment diagrams, it is understood that the railcar body bolster shear force and moment diagrams would illustrate forces similar to the truck bolster shear forces and moments in magnitude, but opposite in sign and direction. In a conventional railcar support scheme, all of load force "$P_{total}$", that is one-half of the total railcar and lading weight for a railcar as in FIG. 9, is transferred from railcar body 19, sidewalls 11 and 13, and body bolster assembly 12 to truck bolster 35 through center plate assembly 24. Each of railcar body bolster assembly 12 and truck bolster 35 has to withstand large shear forces and bending moments. In this scheme, each of railcar body-bolster assembly members 10 and 20, center plate assembly 24 and truck bolster 35 becomes a major contributor to the overall mass or weight of vehicle system 17. In railcar body system 17 with a conventional structural scheme, center plate components 28, 30 require structurally heavy elements for the load transfer between the car body bolster and truck bolster structures, and this area is thus the least desirable load-transfer location, as a weight saving consideration.

However, center plate assembly 24 or its components 28, 30 are positioned at an ideal location in terms of railcar dynamic performance considerations, as center plate assembly 24 is a balanced pivot point region when railcar body 19 rolls about longitudinal axis 14. Railcar body roll is described relative to each of truck sideframes 55 along railcar longitudinal length or axis 14, and in this manner center plate components 28, 30 effectively act as a pivot point for railcar body roll, as illustrated in FIGS. 1, 2, 5 and 7. In conventional railcar bodies 19, sidebearing assemblies 80 are typically provided to dynamically stabilize railcar body 19 during rolling conditions. Sidebearing 80 in the direction of railcar roll will take all or part of the load, thereby shifting the shear and bending moment conditions from bolster centerline 31 for railcar body 19, as illustrated in FIG. 2.

The magnitude of the bending moments, and also inboard of the sidebearing location, the magnitude of the shear forces are slightly lower than the forces for the static condition, since the area around center plate assembly 24 transfers a small portion of the load during rolling. The forces causing railcar body 19 to roll from side-to-side are considered to be some of the "dynamic" forces acting upon suspension system 45. Some of the dynamic forces are laterally imputed forces not associated with the vertically-directed static forces, which dynamic forces can result from conditions such as rail track curving, or from track irregularities including misaligned joints or uneven rails. Although dynamic forces are often lower in magnitude when compared to the static forces acting on the railcar, they are nonetheless very important to suspension system designers. Indicative of their relative importance to railcar design, the American Association of Railroads (AAR) has specified dynamic performance requirements to be met through their M-1001 Chapter XI guidelines and standards. This AAR standard dictates that when a railcar body rolls, the minimum load on any given wheel 70, which is opposite to the direction of roll, must be at least ten (10) percent of the static wheel load that the same wheel 70 would experience when on tangent track. This requirement avoids one side of truck assembly 22 becoming so lightly loaded that a potential for wheel lift could occur, which might result in one entire side of truck assembly 22 and the associated wheels 70 to lose contact with the rails, possibly derailing railcar 17.

Figure 3:
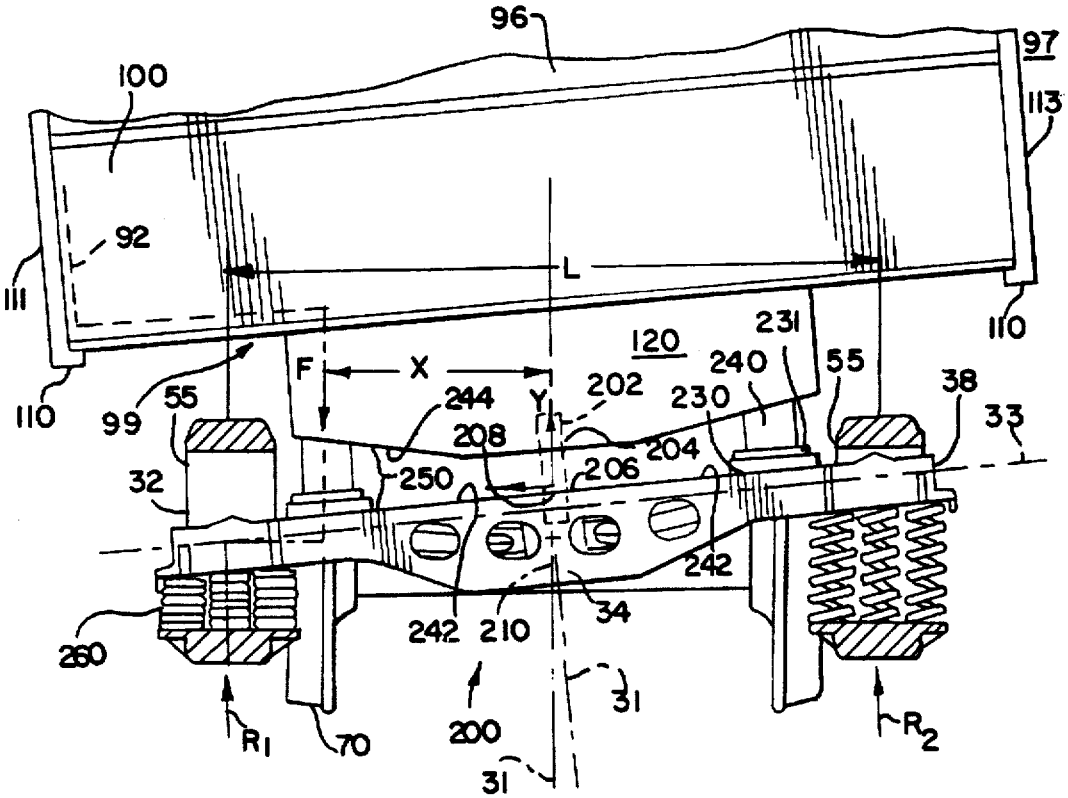
FIG. 3 is a front view of the support system of the present invention showing the location of the car body supports for optimizing dynamic stability of railcar body, when the truck does not use a conventional support scheme.

The schematic elevational view of railcar system 97 in FIG. 3 illustrates the relative structural position and relationship of the components of the present invention. Railcar 97 has railcar body 96, lightweight car body bolster 99 with upper structure 100 and "box" section 120, railcar sidewalls 111, 113, sidesills 110, and truck or truck assembly 200, which assembly 200 includes lightweight truck bolster 210. Lightweight car body bolster 99 and truck bolster 210 are in constant contact at vertical load-carrying sidebearing assemblies 250, which assemblies 250 include car-body-bolster sidebearing pad 240 and truck bolster sidebearing or base 230 with pad 231 mounted thereon for contact with body-bolster pad 240. No vertical static loading occurs along centerline 31 at midsection 34 of either railcar body bolster 99 or truck bolster 210, as center plate assembly 24 (cf., FIGS. 1, 2 and 5) with its bowl 30 and dish 28 arrangement is not required for load force transfer or longitudinal railcar body roll in this railcar system 97. It is understood that a sidebearing assembly 250 is provided on both sides of bolster vertical centerline 31 along bolster horizontal axis 33, however only one sidebearing assembly 250 will be described, and that description applies to both assemblies.

In the present context, the term lightweight is a comparative term relative to extant conventional railcar 17 or 97, and railcar truck assembly 22 or 200. A significant deletion of mass in the railcar body and truck bolsters from equivalently rated railcars is provided by elimination of the requisite center plate support assembly 24 illustrated in FIGS. 1, 7 and 8. This illustrated conventional center plate assembly 24, which was the subject of U.S. Pat. No. 3,664,269 to Fillion, is considered in the industry to be a low-mass center plate support arrangement, but it is still an added weight component utilized to transfer relatively large dynamic and static loads between railcar body 19 and truck assembly 22. In this illustration, mass is related to strength and fatigue resistance, and the ability to both support and transfer load forces from railcar body 19 to truck assembly 22.

In the illustrated embodiment of FIG. 3, all of the railcar load is constantly communicated through and borne by sidebearing assemblies 250, which include railcar body bolster bearing 240 and truck bolster side bearing 230. Truck 200 and railcar body 96 in this embodiment are coupled by pivotal pin 202 centrally located at approximately the midpoint 34 along vertical axis 31 of truck bolster 210 and railcar body bolster 99. Pin 202 in this configuration extends between centrally positioned port 204 in body bolster 99, or more specifically box section 120, and centrally positioned aperture 206 in truck bolster 210 at about its midpoint 208. In operation, pin 202 may be secured in or freely movable in either port 204 or aperture 206 for mating with the opposite aperture or port, and pin 202 maintains railcar body 96 and truck 200 in relative longitudinal position while allowing horizontal pivotal movement between the two components. However, pin 202 does not generally bear any of the vertical load or weight of railcar 97 or its lading.

A proposed sidebearing system 250 has an optimum support location at a distance, X, from vertical centerline 31 to satisfy the requirements of the AAR specifications and the requisite operating criteria. It has been found that the distance X can vary between about 22 inches and 33 inches from the centerline, but it is generally preferable to position the sidebearing assembly between about 27 and 33 inches. This range or variation in position of sidebearing 250 is dependent upon the size of the sidebearing pad surface, the coefficient of friction of the pad materials, the size of the railcar truck, and the type of railcar, but the location of pad or sidebearing 250 within these ranges will provide an operable constant-contact sidebearing assembly system 250 for a freight railcar.

Reduction of the mass and weight of railcars and their various components is an ongoing project among railcar manufacturers and their component suppliers. This constant quest is fostered by economic factors wherein reduction in component weight is translated into greater lading capacity and consequent increased revenues per railcar. However, any change in railcar or their component designs must meet AAR structural and performance standards and specifications. A brief description of the static and dynamic forces and the force balance systems acting on the railcar suspension system components will assist in an understanding of the problems, process and procedure associated with the elimination of structural elements, and thus mass, from a railcar versus conventional railcar force loading and transfer.

One of the most difficult freight railcar operating conditions is an empty or lightly loaded railcar 17, 97, and this discussion will relate to similar railcars 17 and 97 and their related components. In this lightly-loaded condition, dynamic forces become accentuated as suspension system 45 is generally designed for a fully-loaded railcar condition. A particularly difficult problem for lightly-loaded railcars 17, 97 occurs when the railcar encounters curved track at a speed above or below a balanced-against-roll railcar speed, where radial forces operate upon railcar body 19 or 96. The lateral component of the radial forces will operate on the light car body 19 or 96 and induce the railcar to lean or roll on its longitudinal axis 14 in the direction of the curve. This lean or roll causes suspension system 45, 260 to be relieved at wheel 70 opposite the roll direction, which causes railcar body 19 or 96 and the lading weight to be concentrated on one side of railcar body 19, 96 and truck 22, 200. The shift in railcar body 19, 96 and the associated payload weight is depicted as force "F" in FIG. 3. If the dynamic forces become small, track wheels 70 on the opposite or non-concentrated load side of the railcar can lift off the rails, which is a greater hazard when the railcar is empty. In recognition of this hazard possibility, the American Association of Railroads (AAR) sets standards for allowable dynamic wheel lift forces, as noted above. Minimum dynamic wheel load must be at least ten (10) percent of the static wheel load, which occurs while the railcar operates on tangent track. The present invention partially removes the redundant load-transfer path through its positioning of sidebearing assemblies 250, and satisfies the AAR static wheel load value.

Initial resolution of the problem or positioning of assemblies requires a static force determination using the premise that the summation of moments on a statically determinate structure must be zero. For a 100-ton freight car truck, the general industry practice for the distance L between journal bearing centerlines of an axle is 79 inches. Through a force calculation, the best static location for X, that is displacement from the vertical centerline 31 along horizontal axis 33, has been determined to be at $X \leqq 31.6$ inches from the longitudinal centerline of the railcar truck width. For 70-ton and 125-ton cars, this displacement from the centerline varies as the distance "L" between the journal bearings—changes.

Dynamic force evaluation of a railcar body with respect to the location of supporting sidebearing assemblies 250, demonstrates that the above-noted static best location for weight reduction, does not correspond to the best dynamic location for railcar sidebearing assemblies 250. Deflection of track bolster 200 is related to the volume through the bolster and its moment of inertia, that is, the higher the deflection, the higher the moment of inertia for a given strength criteria. When the moment of inertia of a member is increased, the volume and the weight of that same member will also have to be accordingly increased. "*Roark's Formulas for Stress & Strain*" discusses methods for determining the maximum vertical deflection for a simply supported beam, such as railcar truck bolster 210.

Utilizing the above-noted analytical techniques, it can be concluded that the maximum structural weight for truck bolster 210 is required when the railcar and payload weight are transferred to wheels 70 at the center of both body bolster 99 and truck bolster 210, as in a conventionally loaded bolster arrangement. Alternatively, the minimum structural bolster weight can be achieved when the railcar payload is concentrated at the centerline, $R_1$ or $R_2$ in FIG. 3, of the wheel journal bearing. Consequently, the lightest weight truck bolster would have the journal line support at L. However, a railcar truck with this design would not satisfy the dynamic stability criteria required by the AAR.

In the present invention, no vertical loading is provided at the vertical centerline 31 between the car and truck bolsters, that is at X=0. Rather, a more favorable lateral location is provided for constant contact sidebearing assemblies 250 to achieve enhanced railcar truck dynamic stability, while increasing weight savings. At the present time in conventional railcar bolster arrangements, the sidebearings 80 (cf., FIGS. 1, 2, 5 and 7) are positioned at almost 25 inches from centerline 31 for all railcar trucks.

In FIG. 3, pad 240 with an exemplary 9-inch width transverse to the car longitudinal length has the forces or stresses equally distributed across the pad, and the resultant force F is transferred at 27.1 inches from the center of the bolster 210 to provide an optimum lateral location for supporting railcar body 96. In this example, the length of the noted pad can vary with the width of upper surface 26, but a pad with a length of about 14 inches has been utilized in some tests.

Truck bolster sidebearing 230 with pad 231 and body bolster sidebearing 240 are respectively positioned along truck bolster axis 33 on truck bolster upper surface 242 or body bolster lower surface 244 to accommodate the dynamic forces acting on railcar 96 during its operation and to meet the above-noted dynamic operating criteria of the AAR. However, utilization of pivot pin 202 alleviates the requirement for a center pad bowl and dish arrangement 24 for positioning railcar body 96 relative to truck bolster 210. Further for 100-ton trucks, placement of sidebearing assemblies 250 at outboard positions in a range between about 25.0 to 33.0 inches from the truck bolster longitudinal midpoint 31, which assemblies 250 carry all of the vertical load forces at a static condition or a dynamic condition, provides a significantly shorter load-transfer path 92 between sidewalls 111 and 113, railcar body bolster 99, truck bolster 210 and sideframes 55, as noted in FIGS. 3 and 6. Consequently, requisite center-plate structure 24, which is generally utilized in present truck bolsters 210 and body bolsters 99, is not required, thereby reducing the mass and weight of railcar assembly 97 while maintaining the available railcar load-carrying capacity. For a conventional or extant freight railcar 17 having railcar and lading weight, load-path 90 in FIG. 5 is the load communication route to truck bolster 22 from body sidewalls 11, 13, to body bolster 20, through center plate 24 and thereafter to truck bolster 22, sideframes 55 and railcar wheels 70.

FIGS. 3 and 6 illustrate the constant contact between sidebearings of assembly 250 and the shortened load path 92 of the present invention for communication of the load force from railcar 17 to wheel 70 and thus the track. The load force travel distance has been reduced by the value 'S', as shown in FIG. 6, which is effectively the distance between sidebearing assemblies 80 of body bolster 12 or 99 and truck bolster 35 or 210. Lateral control and truck pivoting in the present invention are accommodated by pivot pin 202, which thus functionally provides some of the operating characteristics of the traditional center plate structure. Shortened load path 92 also allows the static load carrying capacity and dynamic operating characteristics of present freight railcars to be maintained in a reduced weight railcar.

Although the above discussion accommodates the static and dynamic loading of railcar 17, 97, the resistance to turning of the truck assembly 200 must also be considered. Indicative of the relative importance of controlling railcar truck rotational resistance, AAR specification M-948 [3] provides that there is a maximum L:V ratio of 0.82 to the railcar trucks, where L in this ratio represents lateral force and V represents vertical force on any single wheel. This ratio can be utilized to determine the light (empty) railcar maximum rotational resistance (torque) of 143,500 in-lbs., and the loaded car maximum rotational resistance (torque) of 1,026,000 in-lbs. for a 40,000 pound tare weight railcar with a maximum loaded car weight of 286,000 pounds. Thereafter, the truck turning resistance can be determined for loaded and light railcars, which turning resistance is a function of the coefficient of friction of the sidebearing pad surfaces. As an example, for pad locations approximately 30 inches from bolster center 31 and a friction pad with a coefficient of friction of 0.128 the turning resistance for a railcar with the above-noted size constraints yields a truck turning resistance of 1,021,440 in.-lbs. for a loaded railcar. Therefore, the sidebearing pad must have a coefficient of friction of less than 0.128 to accommodate the turning resistance requirements of the AAR.

In a conventional railcar, the resistance to turning of truck 22 under railcar body 19 is accommodated by the very short moment arm, that is 14 to 16 inches, of the center plate assembly 24, which generally has a steel-on-steel interface between bowl 28 and dish 30. This metal-to-metal turning resistance is sometimes snared by the side bearing assemblies 80. In a relatively simplistic manner, resistance to truck turning can be considered for a railcar traversing a curve in the track. Railcar wheels 70 have a tapered tread surface with a larger circumference on the inner tread surface near the wheel flange, which varies with the tread-track contacting surface of wheel 70 as the railcar enters a curve. The variance of the wheel circumference across the tread face forces the truck 22 to the inside of the curve, that is the naturally occurring forces 'steer' track 22 toward the inside track. The large moment arm between the sidebearing assemblies 80 of a conventional railcar structure would act in opposition to truck turning when the body bolster pad and truck bolster pads are in contact, as resistance to turning is dependent upon the coefficient of friction of each of pads 82 and 84. However, as conventional railcar pads 82 and 84 are not constantly in contact, and as the vertical load is generally bore at center plate assembly 24 with its short moment arm, conventional railcars 17 and track assemblies 22 are relatively insensitive to resistance to track turning at the sidebearing assemblies.

Alternatively, as the present invention has constant-contact sidebearing assemblies 250 with truck bolster sidebearing 230 and body bolster sidebearing 240, the interface, and more specifically the coefficient of friction, between body bolster pad 240 and track bolster pad 231 is a significant, if not determinative, factor in the resistance to truck turning of the present apparatus. Consequently, the coefficient of friction between the pads 240 and 231 should be less than 0.15 and preferably less than 0.10 to facilitate controlled and uninhibited truck turning for constant contact sidebearing assemblies 250. At this time, it has been found that a bearing pad of a polyurethane composition with approximately ten percent (10%) Teflon as an additive will yield acceptable performance.

Although the above-noted description is specifically provided for an exemplary 100-ton freight car, it is appreciated that a similar analysis can be provided for freight cars of varying lading capacity, which will accommodate variations in sidebearing pad lengths, and thus the provision of the transfer surface between body bolster 120 and truck bolster 210. Further, the relative precision of locating the bearing pads at the distance "X" from the truck midpoint will vary with the freight car lading weight, the structural arrangement between the bolsters and bearing pad proximity to the sideframe. However, the noted location range will provide an operating range to displace the center plate mass to reduce car weight, avoiding resistance to truck turning while providing a railcar truck to accommodate the AAR operating requirements.

Those skilled in the art will recognize that certain variations can be made in the illustrative embodiment. While only specific embodiments of the invention have been described and shown, it is apparent that various alterations and modifications can be made therein. It is, therefore, the intention in the appended claims to cover all such modifications and alterations as may fall within the true scope of the invention.

We claim:

1. In a freight railcar having a railcar body with a railcar longitudinal axis and at least one railcar truck assembly, a center-plate free body bolster and a center-plate-free truck bolster, said railcar body having said railcar body-bolster free of a center plate, a first end wall and a second end wall, a railcar length extending between said first and second end walls, a railcar longitudinal axis, a bottom with a perimeter, a plurality of vertical side walls upwardly extending from said bottom, a railcar width extending between said vertical side walls, a side sill at said perimeter of each said vertical side wall, said bottom, said end walls and said vertical side walls cooperating to define a lading volume, lading in said volume and said railcar body providing a static vertical load to said railcar, said vertical load from said lading and railcar body of the freight railcar borne by said vertical side walls and said end walls, said railcar truck assembly having said truck bolster free of a center plate, a second longitudinal axis generally parallel to said railcar axis, a first sideframe and a second sideframe, said first sideframe having a first midpoint and a first upper surface, said first sideframe defining a first window at about said first midpoint, said second sideframe having a second midpoint and a second upper surface, said second sideframe defining a second window at about said second midpoint, said first sideframe generally parallel to said second sideframe, said railcar axis and said second longitudinal axis, a plurality of bearing pads, said railcar body bolster having a third longitudinal axis, a top side and a bottom side, a body-bolster midpoint, and a pin-receiving port at about said body-bolster midpoint, a first bearing pad mounted on said bottom side between said port and one of said first and second sideframes, and a second bearing pad mounted on said bolster bottom side between said port and the other of said first and second sideframes, said first and second bearing pads cooperating to form a first pair of bearing pads, said truck bolster free of a center plate having a fourth longitudinal axis, an upper side, a first truck-bolster end, a second truck-bolster end, a truck-bolster midpoint about centered between said first and second truck-bolster ends, and an aperture at about said truck-bolster midpoint, a third bearing pad mounted on said truck-bolster upper side between said truck-bolster midpoint and one of said first and second truck-bolster ends, said third bearing pad generally aligned with one of said first and second bearing pads, and a fourth bearing pad mounted on said truck-bolster upper side between said truck-bolster midpoint and the other of said first and second truck-bolster ends, said fourth bearing pad generally aligned with the other of said first and second bearing pads, said third and fourth bearing pads cooperating to form a second pair of bearing pads, a pin positioned in one of said body-bolster port and said truck-bolster aperture, said pin vertically extending to mate with the other of said port and aperture, said third longitudinal axis approximately parallel to said fourth longitudinal axis, said third and fourth parallel axes generally transverse to said railcar axis and said second longitudinal axis, one of said first and second truck-bolster ends extending through said window in one of said first and second sideframes at said sideframe midpoint, and the other of said first and second truck-bolster ends extending through said window in the other of said first and second sideframes at said sideframe midpoint, said railcar body-bolster generally extending between said vertical sidewalls, which body-bolster receives said vertical load for communication to said truck-bolster and said first and second sideframes, each pair of said aligned truck bolster bearing pad and body-bolster sidebearing pad cooperating to define a constant-contact sidebearing assembly to bear and transfer said railcar vertical load, each said constant-contact sidebearing assembly positioned at a location on said truck-bolster upper side less than thirty-three inches from said truck-bolster midpoint along said fourth longitudinal axis to enable provision of a center-plate-free truck bolster and body bolster with both a reduction in the relative weight of the railcar body and truck bolster, and a shorter, less redundant load path between said railcar body and said sideframes while enhancing dynamic railcar stability.

2. A combination of railcar truck assemblies of a freight railcar having a railcar body and a railcar longitudinal axis, said combination comprising:

said railcar body having a first end wall, a first center-plate-free body bolster in proximity to said first end wall, a second end wall, a second center-plate-free body bolster in proximity to said second end wall, and a railcar length extending between said first and second end walls, a railcar body floor with a perimeter, a top side and a lower side, a first vertical sidewall with a first lower edge and a second vertical sidewall with a second lower edge, each said first and second lower edge in proximity to said floor perimeter, a railcar body width between with said first and second sidewalls, a first side sill and a second side sill, one of said first and second side sills longitudinally extending along said perimeter at said first lower edge, and the other of said first and second side sills longitudinally extending along said perimeter at said second lower edge of said vertical side walls, said first and second end walls, and said first and second vertical side walls cooperating with said railcar floor to define a volume for lading, said railcar body and lading cooperating to provide a static vertical load to said railcar, said vertical load from said lading and railcar body being borne partially by said freight railcar first and second vertical side walls for transfer of said vertical load, each said first and second railcar body bolster generally secured at said floor bottom between said first and second vertical sidewalls, which first and second body bolsters each has a second longitudinal axis, a bottom side, a body-bolster midpoint about centered between said first and second body-bolster ends, and a pin-receiving port at about said midpoint;

each said railcar truck assembly having a third longitudinal axis, a truck bolster free of a center plate, a first side frame and a second side frame, which first side frame is generally parallel to said second side frame and said railcar longitudinal axis;

said first side frame having a first longitudinal midpoint and a first window at said first midpoint, said second side frame having a second longitudinal midpoint and a second window at said second midpoint, one of said truck assemblies positioned in proximity to one of said first and second end walls with said truck bolster generally parallel to said respective body bolster and second axis, said truck bolster and second axis generally transverse to said railcar longitudinal axis, and another of said truck assemblies positioned in proximity to the other of said first and second end walls, each said truck bolster having an upper side, a truck-bolster first end, a truck-bolster second end, a truck-bolster midpoint about centered between said first and second truck-bolster ends, and an aperture at about said truck-bolster midpoint, one of said first and second truck-bolster ends extending into one of said first and second windows, and the other of said first and second truck-bolster ends extending into the other of said first and second windows, a pin at about said truck-bolster and body-bolster midpoints mated with and vertically extending between said truck-bolster aperture and said body-bolster port, said railcar body bolsters generally extending between said first and second vertical sidewalls to receive said vertical load for its communication to said side frames, a plurality of body-bolster side bearings, at least one of said body-bolster side bearings mounted on said body-bolster bottom side between said body-bolster midpoint and said first end, and at least another one of said body-bolster side bearings mounted on said body-bolster bottom side between said body-bolster midpoint and said second body bolster end, a plurality of truck side bearings, at least one of said truck side bearings mounted on each said truck bolster upper side between said truck-bolster midpoint and one of said first and second truck-bolster ends, and at least another one of said truck-bolster side bearings mounted on said truck-bolster upper side between said truck-bolster midpoint and the other of said first and second truck-bolster ends, which truck-bolster side bearings and said body-bolster side bearings are generally in vertical alignment, each said generally aligned truck-bolster and body-bolster side bearing cooperating to define a constant-contact sidebearing assembly to bear and transfer said vertical load of said railcar, each said truck side bearing laterally positioned on said truck-bolster upper side less than thirty-three inches from said truck-bolster midpoint and generally along said second longitudinal axis to enable provision of a center-plate-free truck bolster and body bolster with both a reduction in the relative weight of the railcar body and truck bolster, and a shorter, less redundant load path between said railcar body and said sideframes while enhancing dynamic railcar stability.

3. The structure as claimed in claim 1, wherein said vertical load is borne solely by said truck side bearings and said body bolster side bearings, which side bearings cooperate to provide a load-bearing path for said load from said railcar and lading.

4. In a freight railcar having a railcar body with a railcar longitudinal axis and at least one railcar truck assembly, a center-plate-free body bolster and a center-plate-free truck bolster as claimed in claim 1, wherein each said railcar body-bolster first and second bearing pads has a first pad surface, and each said third and fourth bearing pads on said truck bolster has a second pad surface, said first pad surfaces engageable with said aligned truck-bolster second pad surfaces, said first and second bearing pad surfaces and vertical pin cooperating to provide a center-plate-free pivotal arrangement for said freight railcar.

5. In a freight railcar having a railcar body with a railcar longitudinal axis and at least one railcar truck assembly, a center-plate-free body bolster and a center-plate-free truck bolster as claimed in claim 1, each said first and second side frame further comprising a suspension assembly having a spring arrangement, one of said truck bolster first and second ends in each said respective first and second sideframe window positioned on said spring arrangement in said window to communicate said vertical load to said respective spring arrangement and side frame from said body bolster, truck bolster and railcar body.

6. In a freight railcar having a railcar body with a railcar longitudinal axis and at least one railcar truck assembly, a center-plate-free body bolster and a center-plate-free truck bolster as claimed in claim 1, wherein said body-bolster has a first end and a second end, one of said body-bolster first and second ends in proximity to said first and second sidewalls at said bottom and the other of said first and second body-bolster first and second ends in proximity to said first and second sidewalls at said bottom, said body bolster bottom side at said first and second ends operable to contact one of said respective first and second side frame upper surfaces in proximity to said respective first and second end at extreme lateral displacement of said railcar body.

7. In a freight railcar having a railcar body with a railcar longitudinal axis and at least one railcar truck assembly, a center-plate-free body bolster and a center-plate-free truck bolster as claimed in claim 4, said freight railcar being a 100-ton rated railcar, wherein, said body bolster sidebearings pad surface and said truck bolster sidebearings pad surface are about nine inches in width.

8. In a freight railcar having a railcar body with a railcar longitudinal axis and at least one railcar truck assembly, a center-plate-free body bolster and a center-plate-free truck bolster as claimed in claim 1, wherein said freight railcar is a 100-ton rated railcar, said body bolster sidebearings and said truck bolster sidebearings each has a centerline and a generally rectangular pad surface with a width of about nine inches.

9. In a freight railcar having a railcar body with a railcar longitudinal axis and at least one railcar truck assembly, a center-plate-free body bolster and a center-plate-free truck bolster as claimed in claim 8, wherein said truck bolster sidebearing center line and said body bolster sidebearing center line are generally parallel to said railcar longitudinal axis, said longitudinal center lines about transverse to said third axis and positioned less than 33 inches from said truck bolster midpoint.

10. In a freight railcar having a railcar body with a railcar longitudinal axis and at least one railcar truck assembly, a center-plate-free body bolster and a center-plate-free truck bolster as claimed in claim 8, wherein said truck bolster sidebearing center line and said body bolster sidebearing center line are generally parallel to said railcar longitudinal axis, said longitudinal center lines about transverse to said third axis and said sidebearings are positioned along said truck bolster and body bolster with their respective longitudinal center lines at a distance between about more than 25 inches and less than 33 inches from said truck bolster midpoint.

11. A combination of a three-piece truck assembly for a freight railcar with a longitudinal axis, a railcar body for lading, and a load-transfer suspension system between the railcar body and the truck assembly comprising:

said railcar body having a floor, a plurality of vertical side walls, and a railcar body bolster free of a center plate, said lading and said railcar body providing a static vertical load to said three-piece truck assembly, said truck assembly having a first side frame and a second side frame, which side frames are about parallel, and a truck bolster free of a load-bearinq center plate assembly, said truck bolster having an upper side, a first end, a second end and a second longitudinal axis, said truck bolster extending between said first and second side frames, and having a midpoint approximately equidistant between said first and second ends and sideframes;

said railcar body-bolster having a bottom side and a generally centered body-bolster midpoint, said body-bolster midpoint and said truck bolster midpoint approximately aligned at a reference position, said vertical load received by said railcar body bolster from said vertical sidewalls for communication to said truck assembly;

a pivot-pin port defined by one of said truck bolster and body bolster at its respective midpoint, a pivot pin mounted on the other of said truck bolster and body bolster at about the respective other midpoint, said pivot pin generally vertical and matable with said pivot pin port to generally maintain said truck assembly and railcar body in their longitudinal and transverse position relative to said railcar longitudinal axis, said load-transfer suspension system compromising:

a plurality of body-bolster side bearings, at least one of said side bearings mounted on said bottom side between said body-bolster midpoint and one of said first and second side frames, and another one of said side bearings mounted on said body-bolster bottom side between said body-bolster midpoint and the other of said first and second side frames;

a plurality of truck side bearings, at least one of said truck side bearings mounted on said truck-bolster upper side between said truck bolster midpoint and one of said first and second side frames, and another one of said truck side bearings mounted on said upper side between said truck bolster midpoint and the other of said first and second side frames, said body-bolster side bearings and said truck bolster side bearings positioned between said respective first and second side frames and said midpoints are generally in vertical alignment and cooperating to define a constant-contact sidebearing assembly;

each said truck bolster side bearing positioned less than thirty-three inches from said truck-bolster midpoint to provide a center plate free truck bolster and body bolster railcar suspension system, a reduction in the relative weight of said railcar body bolster and said truck bolster, and a shorter, less redundant load path between said railcar body and said first and second sideframes while sustaining dynamic railcar stability.

12. The structure as claimed in claim 9, wherein said railcar body has a first end, a second end, a floor with a perimeter, a first vertical sidewall and a second vertical sidewall, which first and second sidewalls extend between said first and second body ends along said floor perimeter and are generally parallel to said railcar longitudinal axis, said first and second sidewalls defining a railcar width therebetween;

said body bolster having a first end and a second end, one of said first and second ends contacting one of said first and second vertical sidewalls at said perimeter to receive said load, and the other of said first and second ends contacting the other of said first and second sidewalls to receive said load for communication of said load to said side bearings, truck bolster and sideframes.

13. The structure as claimed in claim 11, wherein said body-bolster side bearing and said aligned truck-bolster side bearing are in continuous contact to support all vertical load from said railcar and lading.

14. A center-plate-free, railcar truck assembly and freight railcar body combination of a freight railcar, said combination comprising:

a truck bolster with a first longitudinal center and an upper surface, a first side frame and a second side frame, said truck bolster connecting said first and second side frame;

a railcar body bolster having a second longitudinal center, a lower surface facing and generally parallel to said truck bolster upper surface;

a plurality of truck bolster sidebearings, each said truck-bolster sidebearing having a first bearing surface;

a plurality of body bolster sidebearings, each said body-bolster sidebearing having a second bearing surface;

at least one of said body bolster sidebearings secured to said lower surface between said second center and one of said first and second sideframes, and at least one other of said body bolster sidebearings secured to said lower surface between said second center and the other of said first and second sideframes;

at least one of said truck-bolster sidebearings secured to said truck-bolster upper surface between said truck-bolster first center and one of said first and second sideframes, and at least one other of said truck-bolster sidebearings secured to said upper surface between said truck-bolster center and the other of said first and second sideframes;

said truck-bolster sidebearings and body bolster sidebearings between said respective truck-bolster and body bolster centers and said same first and second sideframes being generally vertically aligned with said respective first and second bearing surfaces in contact, said sidebearings of said contacting first and second bearing surfaces cooperate to define a first pair of sidebearings and a second pair of sidebearings between said truck bolster and body bolster centers and said respective first and second sideframes, each said pair of contacting first and second sidebearings defining a constant-contact sidebearing assembly with said respective first and second bearing surfaces in continuous contact, said sidebearing assemblies between said centers and sideframes at a position less than thirty-three inches from said truck and body bolster centers to provide a shorter, less redundant load force transfer path between said body bolster and said truck bolster while enhancing railcar stability in said center-plate-free, railcar truck and body bolster combination.

15. The structure as claimed in claim 14, said combination further comprising a center pin, said railcar having a first end, a second end, a longitudinal axis, and a railcar floor with a bottom, said railcar body bolster secured to said railcar body bottom in proximity to one of said railcar body first and second ends, said truck bolster defining a center-pin aperture at about said first longitudinal center, said body bolster defining a center-pin port at about said second longitudinal center, said truck-bolster aperture and body-bolster port generally in vertical alignment, said center pin secured in and protruding from one of said aperture and port to mate with the other of said aperture and port, which pin is a non-load bearing pivot apparatus, and provides continuous alignment between said railcar body and said truck assembly as said freight railcar traverses rail tracks.

16. The structure as claimed in claim 14, further comprising a plurality of nonmetallic bearing pads, at least one of said nonmetallic bearing pads mounted and secured to at least one of said first and second bearing surfaces of each said sidebearing assembly.

17. The structure as claimed in claim 16, wherein said nonmetallic bearing pads are polyurethane with a teflon addition.

18. The structure as claimed in claim 16, wherein said nonmetallic bearing pads and the other of said first and second bearing surfaces have a coefficient of friction therebetween of less than 0.15.

19. The structure as claimed in claim 17, wherein said nonmetallic bearing pads of polyurethane have a teflon addition of about ten percent by weight.

20. The structure as claimed in claim 19, wherein said nonmetallic bearing pads of polyurethane have a teflon addition of about ten percent by weight and further include an addition of two percent by weight of silicon.

21. The structure as claimed in claim 15, said freight railcar body having a first end wall, a second end wall, a railcar length extending between said first and second end walls, and a railcar longitudinal axis, said railcar floor having a perimeter, a first vertical sidewall and a second vertical sidewall, said first and second vertical sidewalls cooperating to define a railcar width between said sidewalls, said sidewalls intersecting said perimeter, a side sill at said perimeter intersection with each said vertical side wall, said first and second end walls, and said first and second vertical side walls cooperating with said railcar floor to define a volume for lading, said railcar body and lading in said volume providing a static vertical load to said railcar, said vertical load from said lading and railcar body of the freight railcar borne partially by said freight railcar first and second vertical side walls for transfer of said load, wherein said center-plate-free railcar body bolster has a first end, a second end, a longitudinal axis generally transverse to said railcar axis, a top side, a bottom side with said center-pin port generally centered between said body-bolster first and second ends, said body bolster secured to said bottom between said vertical sidewalls, said first side frame having a first midpoint, and said second side frame having a second midpoint, each said first and second side frame having an upper surface and defining a window at about said midpoint, said center-plate-free truck bolster having a truck-bolster longitudinal axis generally parallel to said body-bolster longitudinal axis, an upper side, a lower side, a first truck-bolster end, a second truck-bolster end, a truck-bolster midpoint about centered between said first and second truck-bolster ends, and a center pin aperture at about said truck-bolster midpoint generally aligned with said body-bolster port, a pin at about said midpoint vertically extending between said truck bolster aperture and said body bolster port, one of said first and second truck-bolster ends extending through said window in one of said first and second sideframes at said sideframe midpoint, and the other of said first and second truck-bolster ends extending through said window in the other of said first and second sideframes at said sideframe midpoint, each of said railcar body-bolster first and second ends generally aligned with at least one of said vertical sidewalls, which first and second body-bolster ends receive said vertical load for communication to said side frames, to provide a center plate free truck bolster and body bolster with both a reduction in the relative weight of the railcar body and truck bolster, and a shorter, less redundant load path between said railcar body and said sideframes while enhancing dynamic railcar stability.

* * * * *